US006019640A

United States Patent [19]

Härri

[11] Patent Number: 6,019,640

[45] Date of Patent: Feb. 1, 2000

[54] COAXIAL CONNECTING MEANS

[75] Inventor: Roger Härri, Oberhelfenschwil, Switzerland

[73] Assignee: Huber+Suhner AG, Herisau, Switzerland

[21] Appl. No.: 08/980,375

[22] Filed: Nov. 28, 1997

[30] Foreign Application Priority Data

Dec. 18, 1996 [CH] Switzerland ..... 3107/96

[51] Int. Cl.[7] ..... H01R 17/04

[52] U.S. Cl. ..... 439/675; 439/502; 439/638

[58] Field of Search ..... 439/578, 502, 439/675

[56] References Cited

U.S. PATENT DOCUMENTS 5,293,013 3/1994 Takahashi ..... 439/502

FOREIGN PATENT DOCUMENTS 2 263 828 8/1993 United Kingdom .
2 291 285 1/1996 United Kingdom .
WO 87/07090 11/1987 WIPO .

*Primary Examiner*—Gary F. Paumen
*Attorney, Agent, or Firm*—Sughrue, Mion, Zinn Macpeak & Seas, PLLC

[57] ABSTRACT

The housing bore (5) is substantially widened in the shape of a step at its edge and the outside diameter (A) of a support plate is widened correspondingly. The contact surface (8) of the housing (2) is reduced in accordance with the step-shaped widened part (7) to form comparatively narrow annular surfaces. An advantage of this is that passive intermodulation can essentially be prevented by the reduction of the contact surface.

12 Claims, 1 Drawing Sheet

COAXIAL CONNECTING MEANS

BACKGROUND OF THE INVENTION

The invention relates to a connecting means having a connecting location to which a further connecting means can be screwed, it being the case that a connecting piece of the inner conductor is arranged at the connecting location in the middle of a housing bore and is supported on the housing by means of an electrically insulating support plate, and that as outer conductor the housing has, coaxial with the connecting piece outside the said housing bores in each case a contact surface as end contact for the outer conductor of the further connecting means.

Connecting elements with such connecting means of this type are known to the person skilled in the art under the title of "U-link", for example. The two connecting means have a common housing, normally produced from aluminium, and are provided with threaded bores by means of which counterparts or measurement adapters can be screwed on at the housing. The contact pressure of the screws is intended to ensure electric contact of the outer conductor at the connecting location. Inserted into each housing bore is a support plate on which the generally female connecting pieces are supported and insulated with respect to the housing.

The said connecting means must, in particular, satisfy requirements based on the electric properties, in particular on the freedom from reflection. In the known connecting means, this has largely been the case up to a frequency of approximately 900 MHz. At higher frequencies, however, interfering reflections occur in the known connecting means during transition from the adapter to the connecting means. In order to reduce such reflections, in the case of one known design the support plate was provided with recesses on the inside, by means of which reflections could be avoided only partly during transition.

SUMMARY OF THE INVENTION

It is the object of the invention to create a coaxial connecting means of the said type which is largely free from reflections at frequencies above 900 MHz. In a connecting means of the generic type, the object is achieved by virtue of the fact that the housing bore in each case is substantially widened in the shape of a step at its edge and the outside diameter of the insulating support plate is correspondingly widened, and in that the contact surfaces of the housing are reduced in accordance with the step-shaped widened part to form comparatively narrow annular surfaces. The said widened part of the housing bores and the corresponding widened part of the insulating support plates on the one hand produce substantial freedom from reflections and, on the other hand, have the effect that the contact surface of the outer conductor is substantially reduced at the housing and is now merely a comparatively narrow and annular surface. The contact of the outer conductor is thus smaller by comparison with the prior art and is limited to the radially external region of the connecting location. Because of the smaller contact surface, the contact pressure is greater given the same contact pressure of the screws. It has proved that the reduction in this contact surface can essentially prevent passive intermodulation. A substantial advantage is also to be seen in that in the case of a narrow annular contact surface unevennesses in the contact surface change the electric properties less than in the case of a substantially wider contact surface. Since, compared to the prior art, it is possible to achieve a larger contact pressure, the housing of the connecting means can also be produced from brass.

According to a preferred development of the connecting means according to the invention, the housing bore is in each case widened to a diameter of approximately 23 mm. This represents an optimum value. The outside diameter of the support plate is then also preferably 23 mm in each case. The support plate is annular and, in accordance with a development of the invention, is produced from polytetrafluoroethylene.

Further advantageous features follow from the dependent patent claims, the subsequent description and the drawing.

BRIEF DESCRIPTION OF THE DRAWINGS

Exemplary embodiments of the invention are explained in more detail below with the aid of the drawing, in which.

DETAILED DESCRIPTION OF THE PRESENT INVENTION

Figure 1:
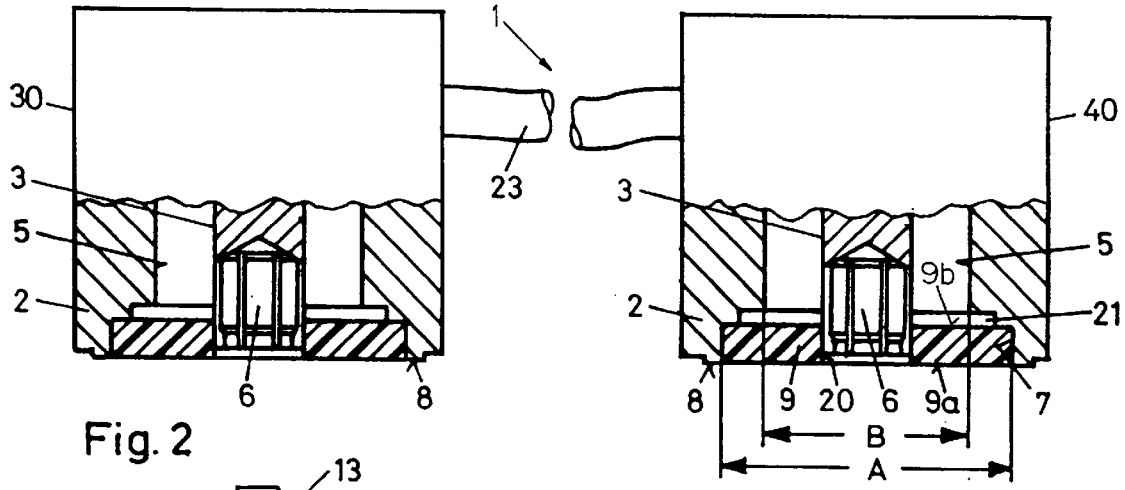
FIG. 1 shows a partial section through a connecting element with two connecting means interconnected by a coaxial cable.

In accordance with FIG. 1, the U-shaped connecting element 1 has two connecting means 30 and 40 which in each case have a housing 2 made, for example, from aluminium or brass, which forms an outer conductor and has an annular and comparatively narrow contact surface 8 for an end contact. The annular contact surfaces 8 in each case surround a bore 5 which is provided at its edge with a step-shaped widened part 7.

Accommodated in the housing 2 is an inner conductor 3 which respectively has at its two ends a female connecting piece 6 which is essentially a slotted sleeve. Between the two connecting means 30 and 40, the inner conductor 3 runs in a coaxial connecting line 23, which can be of varying length. As shown in FIG. 1, the connecting pieces 6 are supported on the housing 2 by means of insulating plates 9 made, for example, from polytetrafluoroethylene (PTFE). As may be seen, the outside diameter A of the plates 9 is substantially larger than the diameter B of the bores 5. The diameter A of the support plates 9 is equal to the diameter of the widened parts 7. The diameter A is preferably 23 mm. The diameter of the bores B is preferably approximately 15 mm. Central bores 20 of the support plates 9 in each case accommodate a connecting piece 6. As may be seen, the contact surfaces 8 are in each case flush with the end face 9*a* of the corresponding plate 9. The rear sides 9*b* of the support plates 9 are flat and parallel to the front side 9*a*. Located in each case behind the plates 9 for the purpose of compensating the narrowing of the diameter is a further step 21 with a somewhat smaller diameter than that of the widened part 7. Because of the widening of the bores 5 and in accordance with the widening of the support plates 9, reflections are largely avoided even in the case of frequencies substantially above 900 MHz, during transition from the connecting means 30 or 40 to the two adapters 11 and 12 which are to be connected and form further connecting means.

Figure 4:
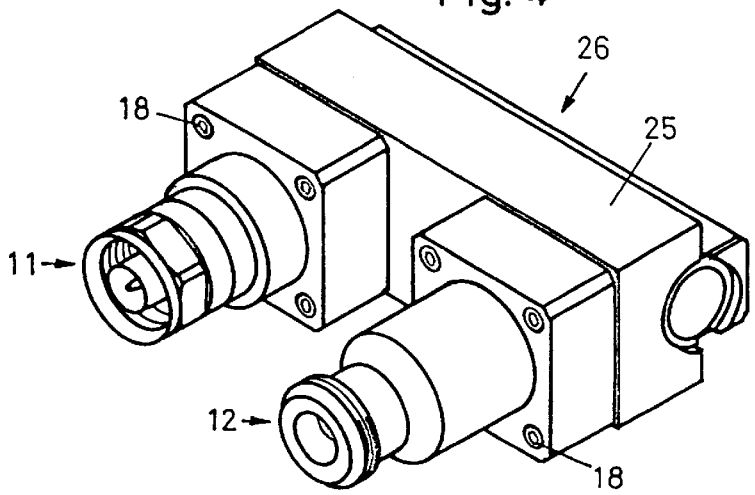
FIG. 4 shows a perspective view of the U-shaped connecting element with two connected adapters.

In the connecting element 26 according to FIG. 4, the two housings 2 are united to form a single housing 25. The inner conductor 3 (not shown) runs inside the housing 2 in this case.

Figure 3:
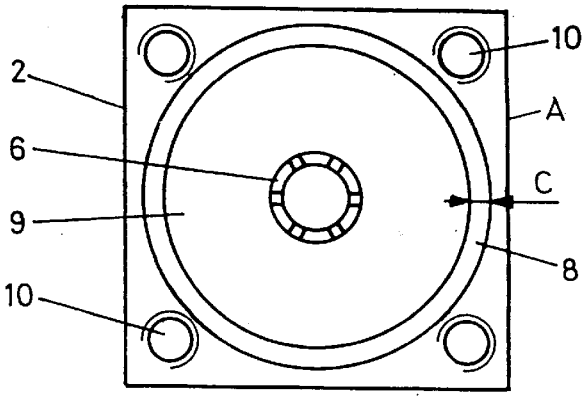
FIG. 3 shows a partial view of a connecting means.

It is essential that the contact sites 8 are comparatively narrow, preferably with a radial width C (FIG. 3) less than 3 mm. The contact surface 8 is substantially smaller than in the case of the known connecting means. The adapters 11 and 12 have corresponding annular and comparatively narrow contact surfaces 19. In order to ensure contact between the surfaces 8 and 9, in accordance with FIG. 4 the adapters 11 and 12 are flange-mounted on the housing 2 by means of four screws (not shown here) in each case. FIG. 3 shows the four threaded bores 10 in the housing 2. Since the contact surfaces 8 are comparatively narrow and radially far outside, it is possible by means of the screws to achieve a higher contact pressure and thus a reliable electric connection.

Figure 2:
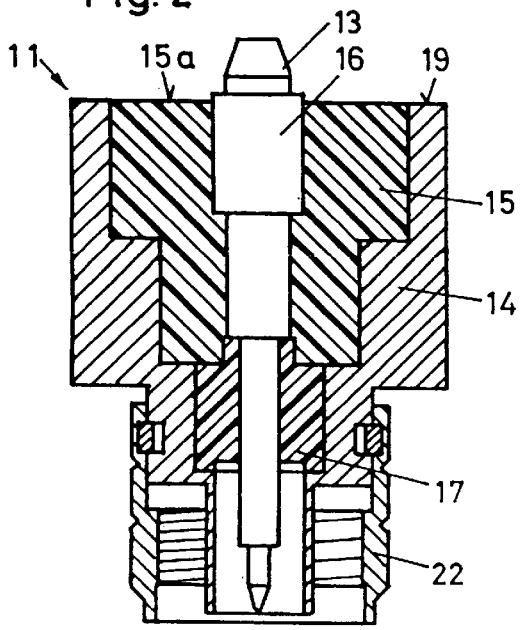
FIG. 2 shows a longitudinal section through an adapter.

The adapter 11 shown in FIG. 2, and also the second adapter 12 form further connecting means, as mentioned above. In the case of the latter, the contact surface 19 is reduced in each case at a housing 14 due to a corresponding widening of an insulator 15 made from PTFE, for example. The adapter 11 has a threaded sleeve 22, rotatably mounted on the housing 14, for the purpose of connecting a coaxial cable (not shown here). A second insulator 17 is inserted into the housing 14 in order to support the inner conductor 16.

Also conceivable is a design in which the connecting element has only one connecting means 30 or 40, and the coaxial line 23 connects this connecting means with a switch, for example.

I claim:

1. A coaxial connector having a connecting location to which a further connector (11, 12) can be screwed, wherein a connecting piece (6) of an inner conductor (3) is arranged at the connecting location in the middle of a housing bore (5) and is supported on a housing (2) by an electrically insulating support plate (9), and an outer conductor formed by the housing (2) has, coaxial with the connecting piece (6) outside the housing bore (5), contact surface (8) for contacting an outer conductor of the further connector (11, 12), the housing bore (5) being substantially widened in the shape of a step at an edge to form a step-shaped widened part (9), wherein an outside diameter (A) of the insulating support plate is correspondingly widened, and the contact surface (8) of the housing (2) is reduced in accordance with the step-shaped widened part (7) to form a comparatively narrow annular surface, whereas the contact surface (8) of the housing is flush with the end face (9*a*) of the electrically insulating support plate (9).

2. The connector according to claim 1, wherein the diameter (A) is approximately 23 mm.

3. The connector according to claim 1, wherein the annular support plate (9) is polytetrafluoroethylene (PTFE).

4. The connector according to claim 1, wherein the contact surface (8) is an annular surface with a radial width (C) of less than 3 mm.

5. The connector according to claim 1, wherein the housing bore (5) has a diameter (B) of 14 to 17 mm.

6. The connector according to claim 1, wherein the further connector (11, 12) has an outer conductor (14) with an annular contact surface (19) corresponding to the contact surface (8).

7. The connector according to claim 6, wherein the further connector (11, 12) comprises an inner conductor (16) and an insulator (15) which supports the inner conductor (16), an end face (15*a*) of the insulator (15) corresponding to the support plate (9).

8. The connector according to claim 1, having two connecting means (30, 40) to form a coaxial U-shaped connecting element.

9. The connector according to claim 8, wherein the two connecting means (30, 40) have a common housing (25).

10. The connector according to claim 8, wherein the two connecting means (30, 40) are interconnected by a coaxial line (23).

11. The connector according to claim 4, wherein the radial width (C) is less than 2 mm.

12. The connector according to claim 5, wherein the diameter (B) is approximately 15 mm.

* * * * *